US007730998B2

(12) United States Patent
Takahashi et al.

(10) Patent No.: US 7,730,998 B2
(45) Date of Patent: Jun. 8, 2010

(54) ELEVATOR APPARATUS

(75) Inventors: Satoru Takahashi, Tokyo (JP); Ken-Ichi Okamoto, Tokyo (JP); Takaharu Ueda, Tokyo (JP); Masunori Shibata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 450 days.

(21) Appl. No.: 11/791,470

(22) PCT Filed: Mar. 20, 2006

(86) PCT No.: PCT/JP2006/305553

§ 371 (c)(1),
(2), (4) Date: May 24, 2007

(87) PCT Pub. No.: WO2007/108091

PCT Pub. Date: Sep. 27, 2007

(65) Prior Publication Data

US 2009/0223746 A1 Sep. 10, 2009

(51) Int. Cl.
*B66B 1/32* (2006.01)

(52) U.S. Cl. ..... 187/288; 187/287

(58) Field of Classification Search ..... 187/277, 187/287, 288, 291, 293, 351, 391–393
See application file for complete search history.

(56) References Cited

U.S. PATENT DOCUMENTS 5,153,389 A * 10/1992 Nomura ..... 187/288
5,244,060 A * 9/1993 Tanaka et al. ..... 187/261
5,402,863 A * 4/1995 Okumura et al. ..... 187/288
5,717,174 A * 2/1998 Ramos ..... 187/288
6,092,630 A * 7/2000 Wendel et al. ..... 187/373
7,080,717 B2 * 7/2006 Ito ..... 187/350
2005/0126862 A1 * 6/2005 Ito ..... 187/350
2006/0180406 A1 * 8/2006 Gremaud et al. ..... 187/355
2009/0133964 A1 * 5/2009 Ueda et al. ..... 187/254
2009/0229924 A1 * 9/2009 Kondo et al. ..... 187/288

FOREIGN PATENT DOCUMENTS

JP 57-85779 5/1982
JP 3 3874 1/1991
JP 3-243576 10/1991

(Continued)

OTHER PUBLICATIONS

U.S. Appl. No. 11/791,850, filed May 30, 2007, Ueda, et al.

(Continued)

*Primary Examiner*—Walter Benson
*Assistant Examiner*—Eduardo Colon-Santana
(74) *Attorney, Agent, or Firm*—Oblon, Spivak, McClelland, Maier & Neustadt, L.L.P.

(57) ABSTRACT

In an elevator apparatus, a brake device stops a car from running. The brake device can adjust the magnitude of part of a total braking force generated at a time of emergency braking of the car. As an example of the brake device, the brake device has a nonadjustable brake portion for immediately generating a braking force without making an adjustment thereof at the time of emergency braking of the car, and an adjustable brake portion for generating a braking force while making an adjustment thereof at the time of emergency braking of the car.

17 Claims, 10 Drawing Sheets

FOREIGN PATENT DOCUMENTS

| | | |
|---|---|---|
| JP | 7 157211 | 6/1995 |
| JP | 9-240936 | 9/1997 |
| JP | 2004 231355 | 8/2004 |
| JP | 2005-126183 | 5/2005 |

OTHER PUBLICATIONS

U.S. Appl. No. 11/794,823, filed Jul. 6, 2007, Ueda, et al.
U.S. Appl. No. 12/064,394, filed Feb. 21, 2008, Ueda, et al.
U.S. Appl. No. 12/532,414, filed Sep. 22, 2009, Ueda, et al.

* cited by examiner

ELEVATOR APPARATUS

TECHNICAL FIELD

The present invention relates to an elevator apparatus allowing the deceleration of a car at a time of emergency braking to be adjusted.

BACKGROUND ART

In a conventional brake device for an elevator, the braking force of an electromagnetic brake is controlled at the time of emergency braking such that the deceleration of a car becomes equal to a predetermined value, based on a deceleration command value and a speed signal (for example, see Patent Document 1).

Patent Document 1: JP 7-157211 A

DISCLOSURE OF THE INVENTION

Problem to be Solved by the Invention

In the conventional brake device as described above and a braking control device, however, the basic operation of emergency braking and the control of a braking force are both performed by a single braking force control unit, so it requires a long time period to perform calculation for controlling the braking force. As a result, there occurs a delay in generating the braking force.

The present invention has been made to solve the above-mentioned problem, and it is therefore an object of the present invention to obtain an elevator apparatus allowing the operation of emergency braking to be started more reliably and swiftly while suppressing the deceleration at the time of emergency braking.

Means for Solving the Problem

An elevator apparatus according to the present invention includes: a car and a brake device for stopping the car from running. The brake device can adjust a magnitude of part of a total braking force generated at a time of emergency braking of the car.

BEST MODES FOR CARRYING OUT THE INVENTION

Preferred embodiments of the present invention will be described hereinafter with reference to the drawings.

Embodiment 1

Figure 1:
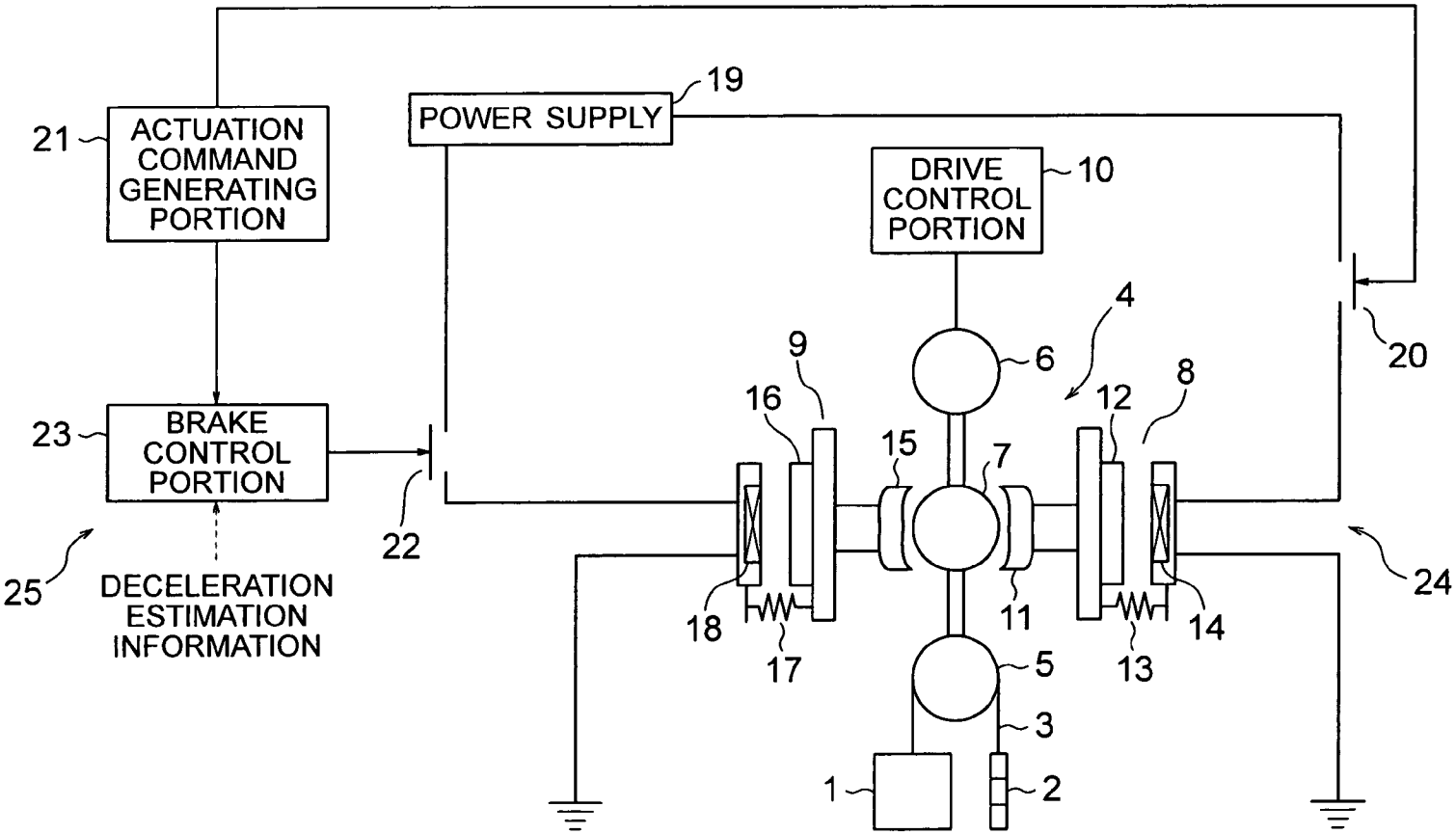
FIG. 1 is a schematic diagram showing an elevator apparatus according to Embodiment 1 of the present invention.

FIG. 1 is a schematic diagram showing an elevator apparatus according to Embodiment 1 of the present invention. Referring to FIG. 1, a car 1 and a counterweight 2 are suspended within a hoistway by a main rope 3. The car 1 and the counter weight 2 are raised/lowered within the hoistway due to a driving force of a hoisting machine 4.

The hoisting machine 4 has a drive sheave 5 around which the main rope 3 is looped, a motor 6 for rotating the drive sheave 5, a brake drum 7 as a brake rotational body that is rotated integrally with the drive sheave 5 as the car 1 runs, a first brake portion body 8 for braking rotation of the drive sheave 5, and a second brake portion body 9 for braking rotation of the drive sheave 5. The driving of the motor 6 is controlled by a drive control portion 10 as an operation control portion.

The first brake portion body 8 has a first brake shoe 11 that is brought into contact with and away from the brake drum 7, a first armature 12 mounted on the first brake shoe 11, a first braking spring 13 for pressing the first brake shoe 11 against the brake drum 7, and a first brake coil 14 disposed facing the first armature 12 to generate an electromagnetic force for opening the first brake shoe 11 away from the brake drum 7 against the first braking spring 13.

The second brake portion body 9 has a second brake shoe 15 that is brought into contact with and away from the brake drum 7, a second armature 16 mounted on the second brake shoe 15, a second braking spring 17 for pressing the second brake shoe 15 against the brake drum 7, and a second brake coil 18 disposed facing the second armature 16 to generate an electromagnetic force for opening the second brake shoe 15 away from the brake drum 7 against the second braking spring 17.

The first brake portion body 8 has such a braking force as can stop the car 1 even when the braking force of the second brake portion body 9 remains canceled.

A first brake switch 20 is provided between the first brake coil 14 and a power supply 19. By closing the first brake switch 20, a power is supplied from the power supply 19 to the first brake coil 14, so the first brake shoe 11 is opened away from the brake drum 7. By opening the first brake switch 20, the supply of the power to the first brake coil 14 is shut off, so the first brake shoe 11 is pressed against the brake drum 7 by the first braking spring 13.

The first brake switch 20 is directly opened/closed depending on whether or not there is a brake actuation command (including a normal braking command and an emergency braking command) from an actuation command generating portion 21. The actuation command generating portion 21 and the drive control portion 10 are provided in an elevator control device (a control panel). The elevator control device has a first computer having a calculation processing portion (a CPU), a storage portion (a ROM, a RAM, a hard disk, and the like), and signal input/output portions. The elevator control device is provided with a safety circuit for generating an emergency braking command.

When the car 1 is stopped at a stop floor during normal operation, the actuation command generating portion 21 generates a brake actuation command. In causing the car 1 to run, the actuation command generating portion 21 cancels the brake actuation command, that is, generates a brake opening command. In addition, the actuation command generating portion 21 also generates a brake actuation command when the need to stop the car 1 as an emergency measure arises due to some abnormality while the car 1 is running.

A second brake switch 22 is provided between the second brake coil 18 and the power supply 19. By closing the second brake switch 22, a power is supplied from the power supply 19 to the second brake coil 18, so the second brake shoe 15 is opened away from the brake drum 7. By opening the second brake switch 22, the supply of the power to the second brake coil 14 is shut off, so the second brake shoe 15 is pressed against the brake drum 7 by a second braking spring 17.

Employed as the second brake switch 22 is a switch allowing the amount of the current supplied to the second brake coil 18 to be adjusted, for example, an open/close switch capable of chopping or a slide switch for continuously changing a resistance value. The following description of Embodiment 1 of the present invention will be given as to a case where the open/close switch is employed. However, in a case where the slide switch is employed, the switch is slid to change the resistance value instead of being turned ON/OFF.

The turning ON/OFF of the second brake switch 22 is controlled by a brake control portion (braking force control portion) 23. The brake control portion 23 has a second computer having a calculation processing portion (a CPU), a storage portion (a ROM, a RAM, a hard disk, and the like), and signal input/output portions. That is, the function of the brake control portion 23 is realized by the second computer. A program for realizing the function of the brake control portion 23 is stored in the storage portion of the second computer.

When a brake actuation command is generated in stopping the car 1, the brake control portion 23 opens the second brake switch 22. When a brake opening command is generated, the brake control portion 23 closes the second brake switch 22.

In addition, when a brake actuation command is generated while the car 1 is running, the brake control portion 23 estimates (or detects) a deceleration (the absolute value of a negative acceleration) of the car 1 based on deceleration estimation information for estimating the deceleration of the car 1, and controls an electromagnetic force generated by the second brake coil 18, namely, an open/close state of the second brake switch 22 so as to prevent the deceleration of the car 1 from becoming excessively high or low. Thus, the brake control portion 23 controls a pressing force with which the second brake shoe 15 is pressed against the brake drum 7.

Available as the deceleration estimation information is information from a hoisting machine rotation detector for detecting rotation of the motor 6, a car position detector provided on a speed governor, a return pulley rotation detector for detecting rotation of a return pulley around which the main rope 3 is looped, a weighing device for detecting a load within the car 1, a speedometer mounted on the car 1, an accelerometer mounted on the car 1, an axial torque meter for detecting an axial torque of the drive sheave 5, or the like. Employable as the rotation detector and the car position detector are encoders or resolvers.

A first brake portion 24 serving as a nonadjustable brake portion has the first brake portion body 8 and the first brake switch 20. A second brake portion 25 serving as an adjustable brake portion has the second brake portion body 9, the second brake switch 22, and the brake control portion 23. A brake device has the first brake portion 24 and the second brake portion 25.

The first brake portion 24 generates a braking force immediately without making an adjustment thereof at the time of emergency braking of the car 1. The second brake portion 25 generates a braking force while making an adjustment thereof at the time of emergency braking of the car 1. Accordingly, the brake device can adjust the magnitude of part of a total braking force (braking force of second brake portion 25) generated at the time of emergency braking of the car 1. Conversely, the brake device applies a braking force excluding an adjustable component thereof immediately without making an adjustment thereof, at the time of emergency braking.

More specifically, when a brake actuation command is generated while the car 1 is running, the first brake switch 20 is opened immediately, so the first brake portion body 8 applies a braking force to the brake drum 7 immediately. Thus, the car 1 starts being decelerated.

The brake control portion 23 monitors the deceleration of the car 1. When the deceleration of the car 1 is lower than a preset threshold, the brake control portion 23 turns the second brake switch 22 OFF to cause the second brake portion body 9 to apply a braking force to the brake drum 7. When the deceleration of the car 1 becomes equal to or higher than the threshold, the brake control portion 23 turns the second brake switch 22 ON to cancel the braking force applied by the second brake portion body 9.

In the elevator apparatus structured as described above, the brake device can adjust the magnitude of part of a total braking force generated at the time of emergency braking of the car 1, so it is possible to start the operation of emergency braking more reliably and swiftly while suppressing a deceleration at the time of emergency braking. It is therefore possible to prevent a deterioration in riding comfort resulting from an excessively high deceleration or an extension of braking distance resulting from an excessively low deceleration.

The brake device has the first brake portion 24 for generating a braking force immediately without making an adjustment thereof, and the second brake portion 25 for generating a braking force while making an adjustment thereof. It is therefore possible to easily set the magnitude of the braking force generated without being adjusted and the magnitude of the braking force generated while being adjusted.

Embodiment 2

Figure 2:
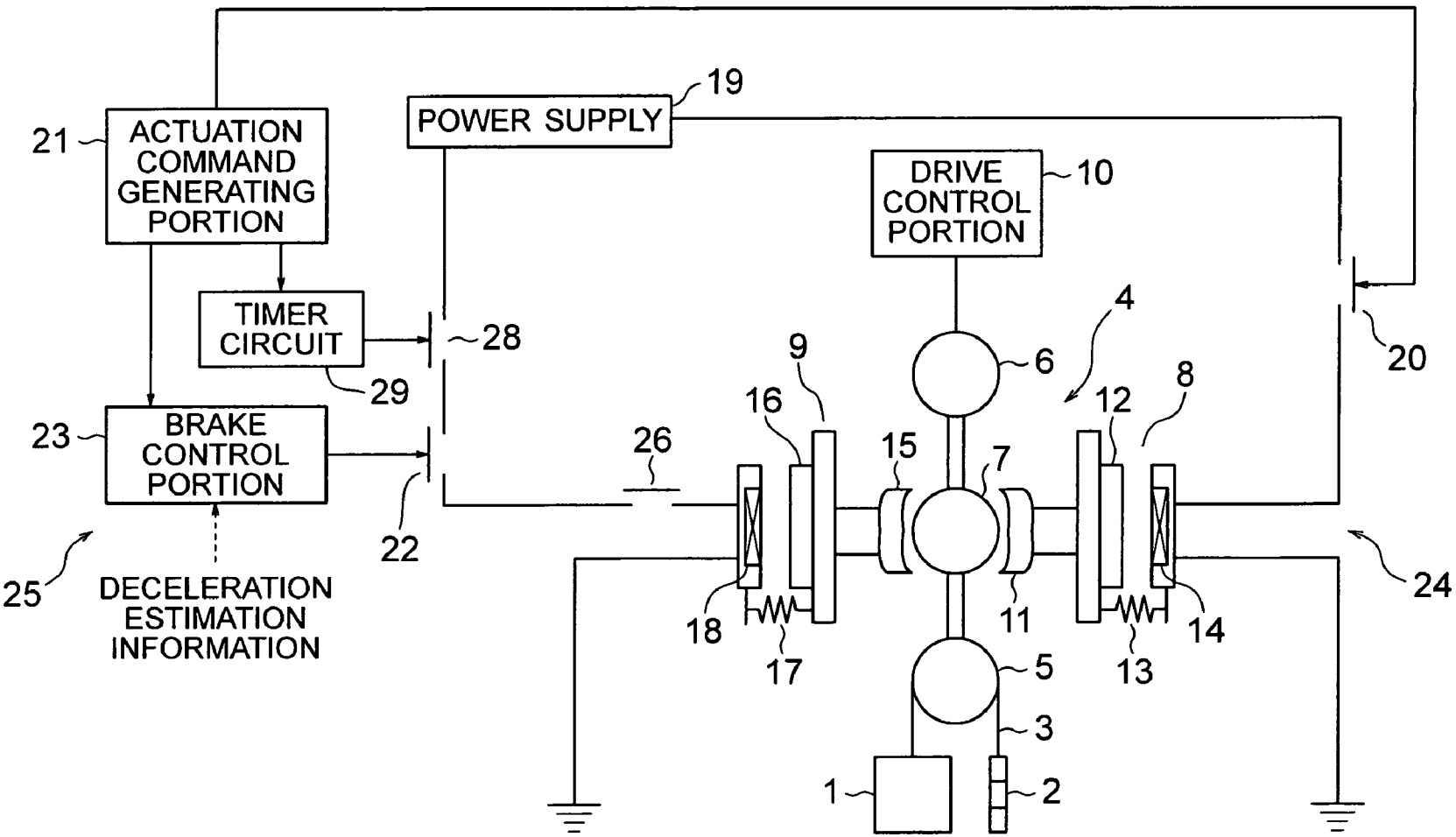
FIG. 2 is a schematic diagram showing an elevator apparatus according to Embodiment 2 of the present invention.

Next, FIG. 2 is a schematic diagram showing an elevator apparatus according to Embodiment 2 of the present invention. Referring to FIG. 2, a forcible braking switch 26 is provided between the second brake coil 18 and the power supply 19. The forcible braking switch 26 is connected in series to the second brake switch 22 and is normally closed. The forcible braking switch 26 is opened in response to an external signal. When the forcible braking switch 26 is opened, the control performed by the brake control portion 23 is thereby invalidated, so a total braking force is forcibly generated by the second brake portion body 9.

A timer switch 28 is connected in series to the second brake switch 22. The timer switch 28, which is normally closed, is opened in response to an opening command from a timer circuit 29. A brake actuation command from the actuation command generating portion 21 is input to the timer circuit 29.

Upon receiving the brake actuation command, the timer circuit 29 starts measuring (counting down) a time, and outputs the opening command to the timer switch 28 after the lapse of a predetermined time from a moment when the brake actuation command is input thereto. Accordingly, the braking force control of the second brake portion body 9 by the brake control portion 23 is invalidated after the lapse of a predetermined time from a moment when the brake actuation command is generated. When the brake actuation command is canceled, the measurement of the time by the timer circuit 29 is reset, so the timer switch 28 is closed. Embodiment 2 of the present invention is identical to Embodiment 1 of the present invention in other configurational details.

In the elevator apparatus structured as described above, the forcible braking switch 26 is provided between the second brake coil 18 and the power supply 19. It is therefore possible to invalidate the control performed by the brake control portion 23 according to need and hence cause the second brake portion body 9 to perform braking operation immediately.

The control performed by the brake control portion 23 is invalidated after the lapse of the predetermined time from the moment when an emergency braking command is generated. It is therefore possible to stop the car 1 more reliably even when there is a malfunction in the brake control portion 23.

In addition, the brake actuation command is input to the brake control portion 23. It is therefore possible to cause the brake control portion 23 to perform braking force control only when the brake actuation command is generated.

Embodiment 3

Figure 3:
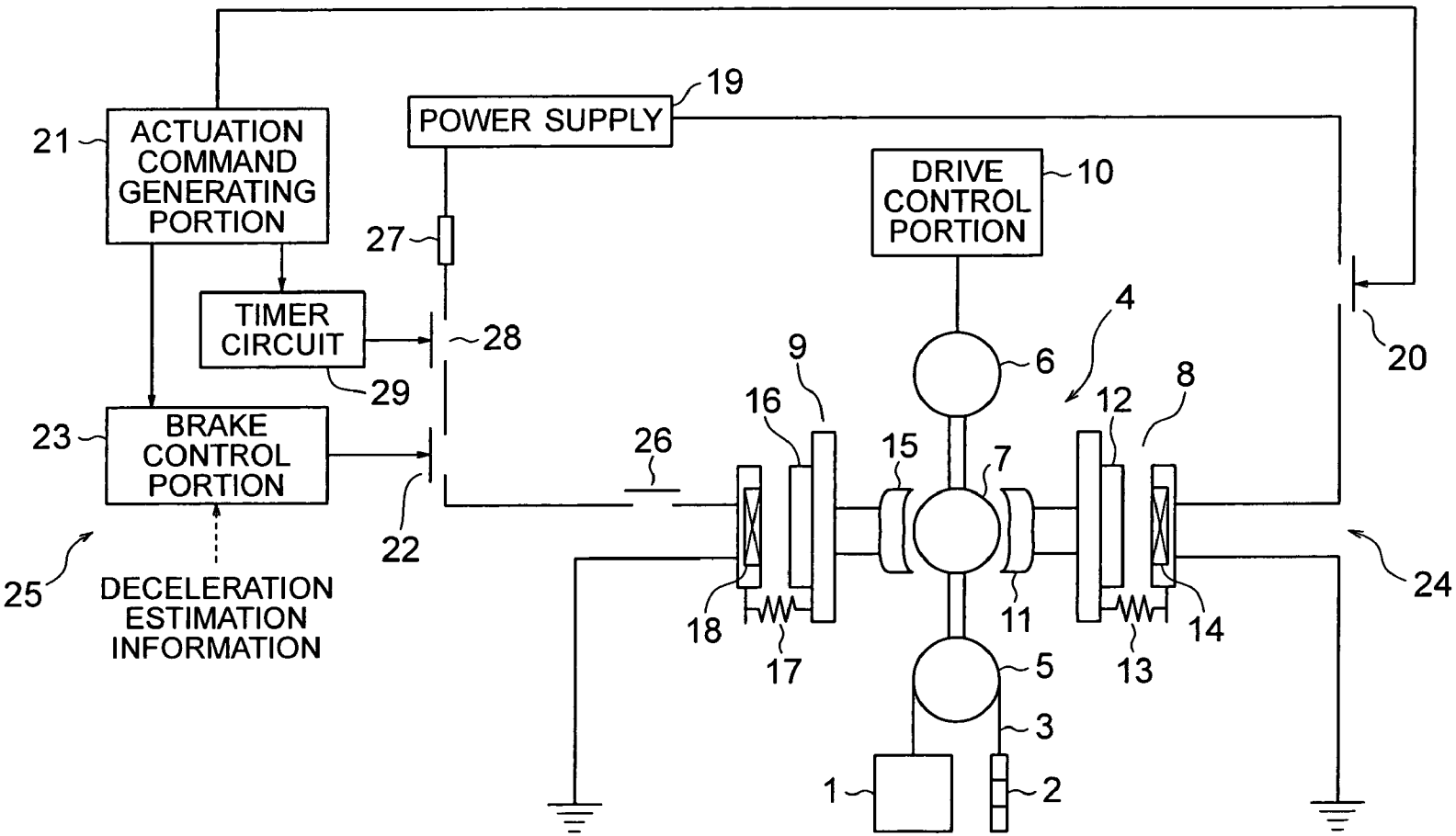
FIG. 3 is a schematic diagram showing an elevator apparatus according to Embodiment 3 of the present invention.

Next, FIG. 3 is a schematic diagram showing an elevator apparatus according to Embodiment 3 of the present invention. Referring to FIG. 3, a current limiter 27 is connected between the timer switch 28 and the power supply 19. The current limiter 27 prescribes an upper limit of the amount of the current flowing through the second brake coil 18. Employed as the current limiter 27 is, for example, a resistor. Embodiment 3 of the present invention is identical to Embodiment 2 of the present invention in other configurational details.

In the elevator apparatus structured as described above, it is possible to suitably limit the control amount of the second brake portion body 9 owing to the presence of the current limiter 27 even when normal control of the second brake switch 22 becomes impossible in the unlikely event of a malfunction in the brake control portion 23.

Embodiment 4

Figure 4:
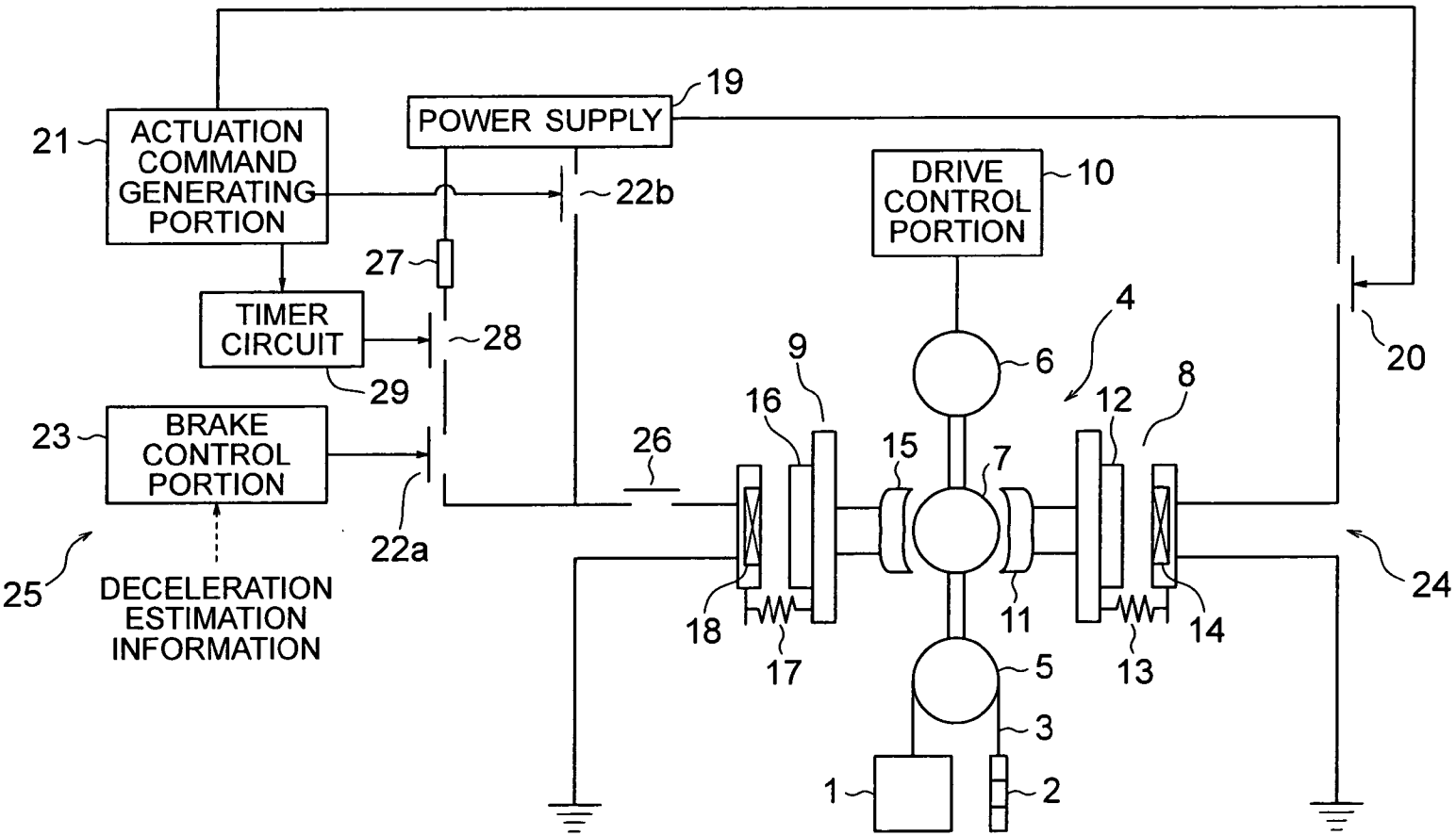
FIG. 4 is a schematic diagram showing an elevator apparatus according to Embodiment 4 of the present invention.

Next, FIG. 4 is a schematic diagram showing an elevator apparatus according to Embodiment 4 of the present invention. Referring to FIG. 4, a second brake switch 22*b* is connected between the second brake coil 18 and the power supply 19. An adjustment switch 22*a*, the timer switch 28, and the current limiter 27 are connected in parallel with the second brake switch 22*b* between the second brake coil 18 and the power supply 19. The adjustment switch 22*a*, the timer switch 28, and the current limiter 27 are connected in series to one another.

A normal open/close switch is employed as the second brake switch 22*b*. The second brake switch 22*b* is directly opened/closed depending on whether or not there is a brake actuation command, without the intermediation of the brake control portion 23.

The adjustment switch 22*a* is normally open. That is, the adjustment switch 22*a* is open except when the deceleration of the car 1 becomes equal to or higher than a predetermined value. Employed as the adjustment switch 22*a* is a switch allowing the amount of the current supplied to the brake coil 18 to be adjusted, for example, an open/close switch capable of chopping, or a slide switch for continuously changing a resistance value. The following description of Embodiment 4 of the present invention will be given as to a case where the open/close switch is employed. However, in a case where the slide switch is employed, the switch is slid to change the resistance value instead of being turned ON/OFF.

When the second brake switch 22*b* is opened while the adjustment switch 22*a* is open, the supply of a power to the second brake coil 18 is thereby shut off, so the brake shoe 15 is pressed against the brake drum 7 by a second braking spring 17. When the second brake switch 22*b* is closed, the second brake coil 18 is thereby supplied with a power, so the brake shoe 15 is opened away from the brake drum 7.

The turning ON/OFF of the adjustment switch 22*a* is controlled by the brake control portion 23. The brake control portion 23 monitors the deceleration of the car 1 during the running thereof regardless of whether or not there is a brake actuation command, and controls an electromagnetic force generated by the second brake coil 18, namely, an open/close state of the adjustment switch 22*a* such that the deceleration of the car 1 does not become excessively high or low. The brake control portion 23 detects and monitors the deceleration of the car 1 independently of the drive control portion 10. That is, deceleration estimation information for measuring or estimating a deceleration is directly input to the brake control portion 23 from a sensor or the like instead of being input thereto from the elevator control device.

The current limiter 27 prescribes the upper limit of the amount of the current flowing through the second brake coil 18 when the second brake switch 22*b* is opened. Employed as the current limiter 27 is, for example, a resistor. Embodiment 4 of the present invention is identical to Embodiment 2 of the present invention in other configurational details.

In the elevator apparatus structured as described above, the adjustment switch 22*a* for adjusting a braking force is disposed in parallel with the brake switch 22*b* in a circuit, and the second brake switch 22*b* is opened immediately in response to a brake actuation command. It is therefore possible to cause the second brake portion body 9 as well as the first brake portion body 8 to perform braking operation immediately without an operational delay when the brake actuation command is generated.

It is also possible to continue the running of the elevator apparatus while keeping the brake control portion 23 from performing the control of deceleration even when there is a malfunction in the brake control portion 23.

Further, the brake control portion 23 detects and monitors the deceleration of the car 1 independently of the drive control portion 10. It is therefore possible to improve the reliability.

Still further, the current limiter 27 is employed to set the upper limit of the amount of the current supplied to the second brake coil 18 which can be controlled by the brake control portion 23, so only part of a power-supply voltage is applied to the second brake coil 18. Accordingly, it is possible to suitably limit the amount of the control of the second brake portion body 9 by the brake control portion 23.

Embodiment 5

Figure 5:
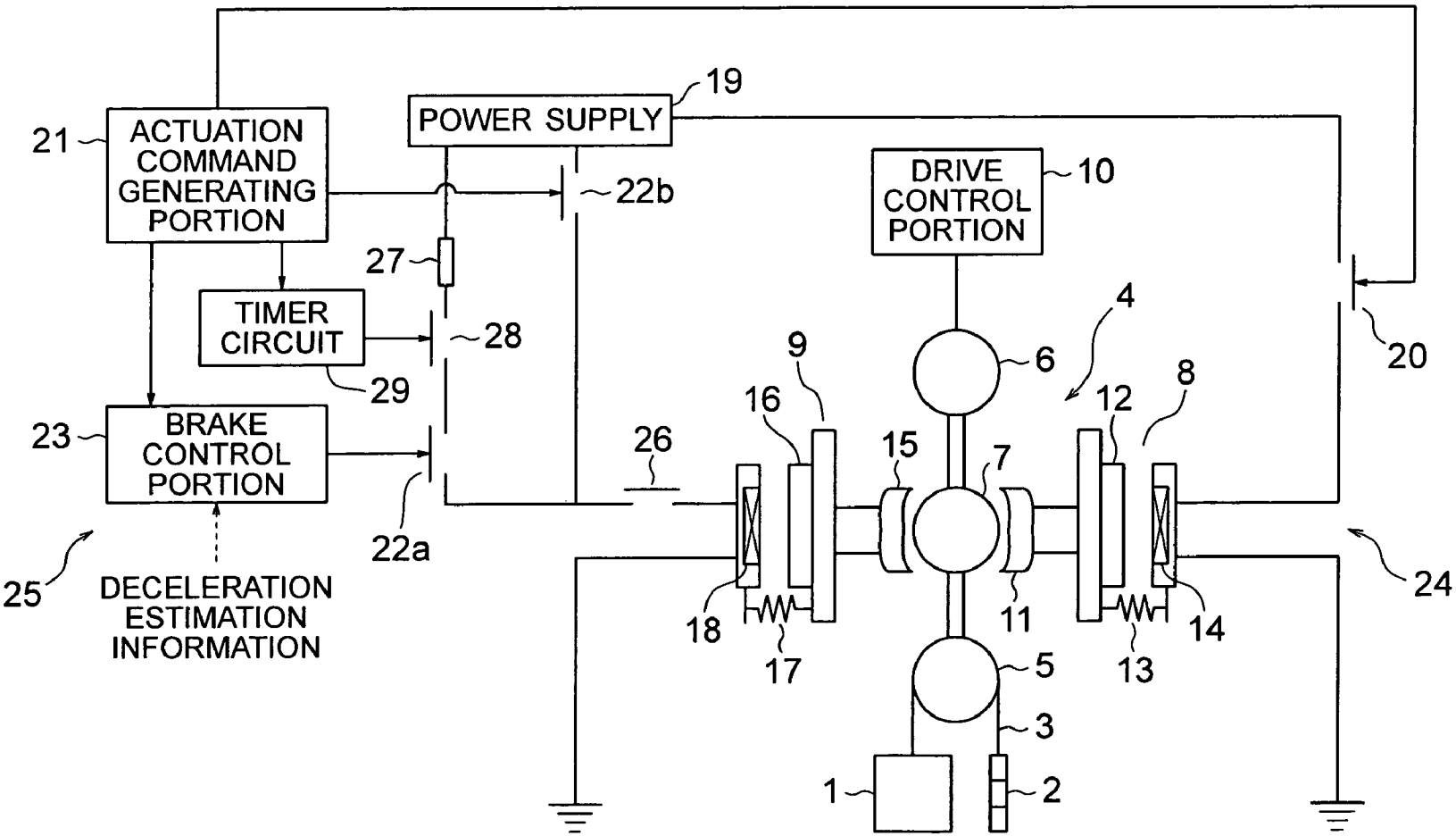
FIG. 5 is a schematic diagram showing an elevator apparatus according to Embodiment 5 of the present invention.

Next, FIG. 5 is a schematic diagram showing an elevator apparatus according to Embodiment 5 of the present invention. Referring to FIG. 5, a brake actuation command from the actuation command generating portion 21 is input to the brake control portion 23. When the brake actuation command is input to the brake control portion 23, the brake control portion 23 monitors the deceleration of the car 1 during the running thereof, and controls an electromagnetic force generated by the second brake coil 18, namely, an open/close state of the adjustment switch 22*a* such that the deceleration of the car 1 does not become excessively high or low. Embodiment 5 of the present invention is identical to Embodiment 4 of the present invention in other configurational details.

As described above, it is also appropriate to allow the brake control portion 23 to control the deceleration of the car 1 only when the brake actuation command is generated.

Embodiment 6

Figure 6:
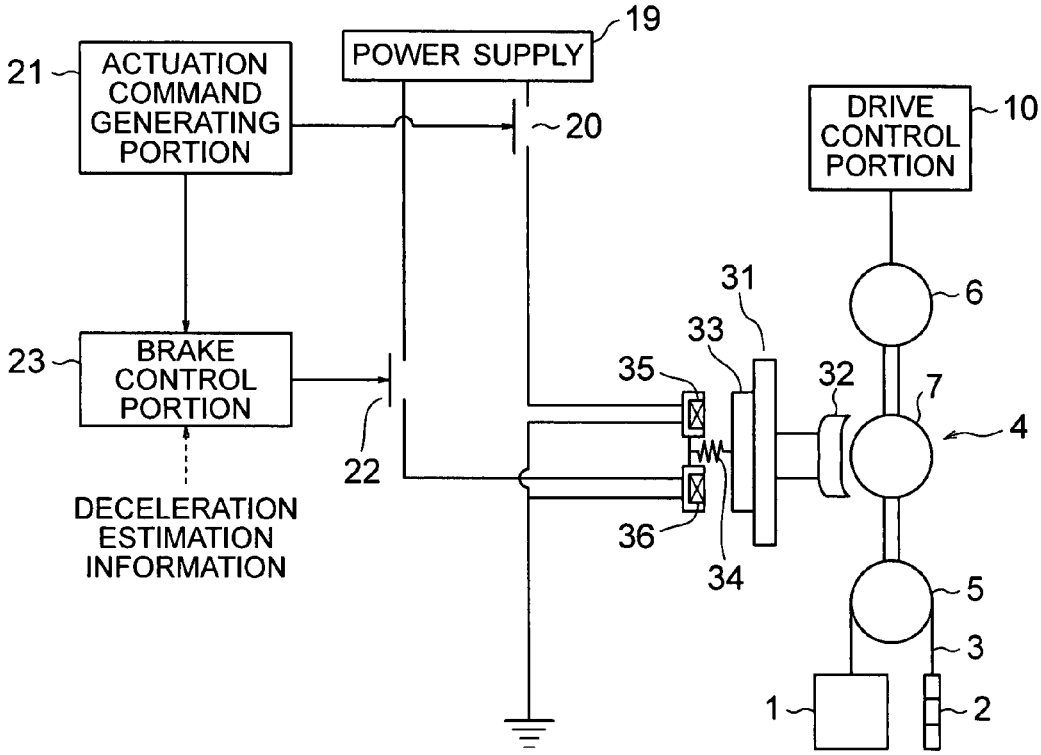
FIG. 6 is a schematic diagram showing an elevator apparatus according to Embodiment 6 of the present invention.

Next, FIG. 6 is a schematic diagram showing an elevator apparatus according to Embodiment 6 of the present invention. Referring to FIG. 6, the hoisting machine 4 has the drive sheave 5, the motor 6, the brake drum 7, and a brake portion body 31. The brake portion body 31 has a brake shoe 32 that is brought into contact with and away from the brake drum 7, an armature 33 mounted on the brake shoe 32, a braking spring 34 for pressing the brake shoe 32 against the brake drum 7, a first brake coil 35, and a second brake coil 36. Each of the first brake coil 35 and the second brake coil 36 is disposed facing the armature 33 to generate an electromagnetic force for opening the brake shoe 32 away from the brake drum 7 against the braking spring 34.

The first brake switch 20 is provided between the first brake coil 35 and the power supply 19. The first brake switch 20 is opened/closed depending on whether or not there is a brake actuation command. The second brake switch 22 is provided between the second brake coil 36 and the power supply 19. The turning ON/OFF of the second brake switch 22 is controlled by the brake control portion 23.

The nonadjustable brake portion has the brake shoe 32, the armature 33, the braking spring 34, the first brake coil 35, and the first brake switch 20. The adjustable brake portion has the brake shoe 32, the armature 33, the braking spring 34, the second brake coil 36, the second brake switch 22, and the brake control portion 23. The brake device has the nonadjustable brake portion and the adjustable brake portion. Embodiment 6 of the present invention is identical to Embodiment 1 of the present invention in other configurational details.

When a brake actuation command is generated in stopping the car 1, the first brake switch 20 and the second brake switch 22 are opened, so a total braking force of the brake portion body 31 is applied to the brake drum 7. When a brake opening command is generated in causing the car 1 to run, the first brake switch 20 and the second brake switch 22 are closed, so the braking force of the brake portion body 31 is canceled.

In addition, when a brake actuation command is generated while the car 1 is running, the first brake switch 20 is opened immediately, so a braking force obtained by subtracting a suction force of the second brake coil 36 from a pressing force of the braking spring 34 is applied to the brake drum 7 immediately. At this moment, the brake actuation command is also input to the brake control portion 23, so the open/close state of the second brake switch 22 is controlled by the brake control portion 23.

That is, the brake control portion 23 monitors the deceleration of the car 1. When the deceleration of the car 1 is lower than a preset threshold, the brake control portion 23 opens the second brake switch 22. When the deceleration of the car 1 becomes equal to or higher than the threshold, the brake control portion 23 closes the second brake switch 22.

In the elevator apparatus structured as described above, the brake device can adjust the magnitude of part of a total braking force generated at the time of emergency braking of the car 1, so it is possible to start the operation of emergency braking more reliably and swiftly while suppressing a deceleration at the time of emergency braking. It is therefore possible to prevent a deterioration in riding comfort resulting from an excessively high deceleration or an extension of braking distance resulting from an excessively low deceleration.

It is optional whether the braking force of the adjustable brake portion is equal to or different from the braking force of the nonadjustable brake portion. The braking forces of the nonadjustable brake portion and the adjustable brake portion can be adjusted by changing the capacities of the first brake coil 35 and the second brake coil 36, respectively.

Embodiment 7

Figure 7:
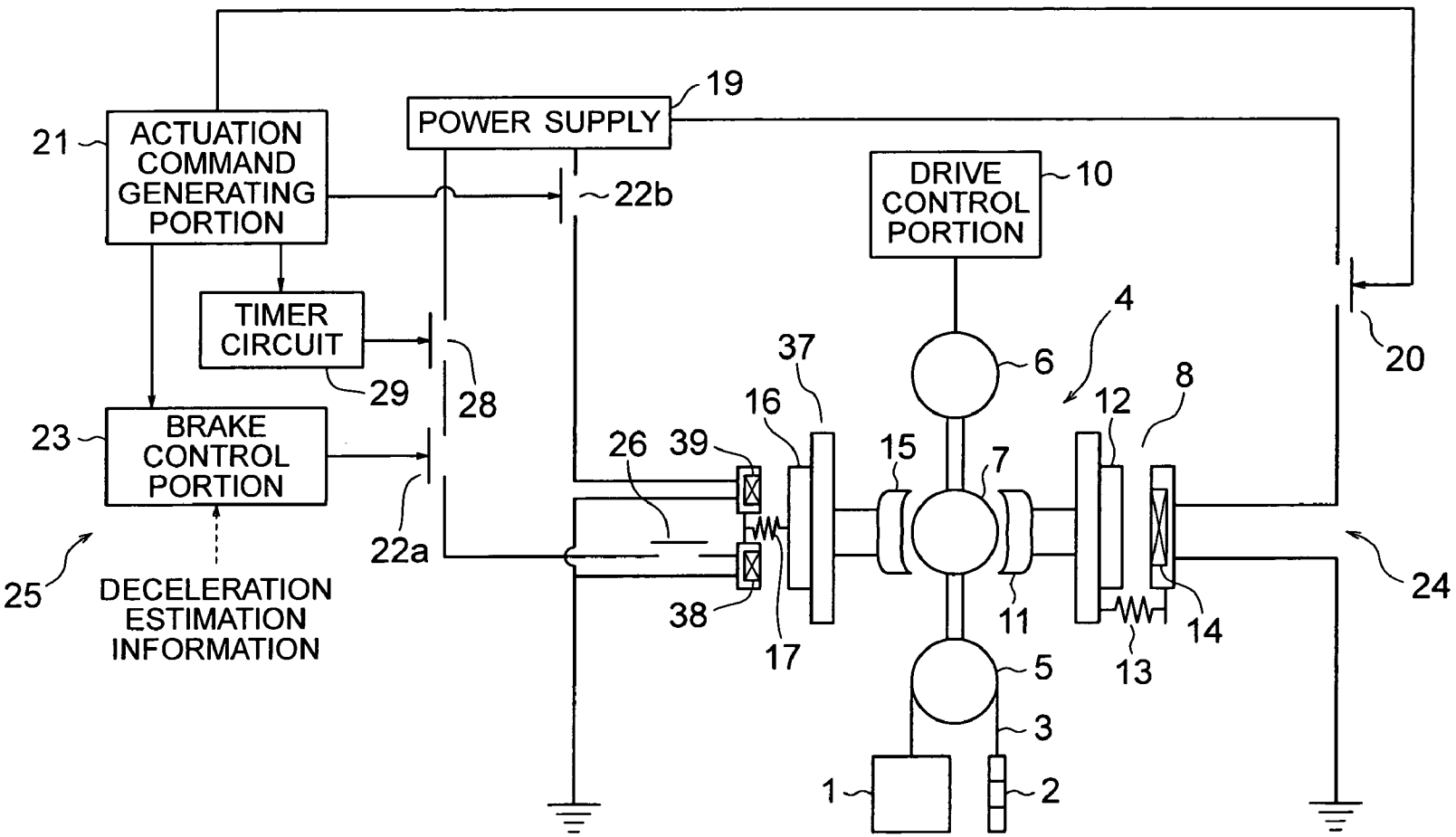
FIG. 7 is a schematic diagram showing an elevator apparatus according to Embodiment 7 of the present invention.

Next, FIG. 7 is a schematic diagram showing an elevator apparatus according to Embodiment 7 of the present invention. Referring to FIG. 7, a second brake portion body 37 has the second brake shoe 15, the second armature 16, the second braking spring 17, a second brake coil 38, and a third brake coil 39.

The timer switch 28, the adjustment switch 22*a*, and the forcible braking switch 26 are connected in series between the second brake coil 38 and the power supply 19. The turning ON/OFF of the adjustment switch 22*a* is controlled by the brake control portion 23.

The second brake switch 22*b* is provided between the third brake coil 39 and the power supply 19. The second brake switch 22*b* is opened/closed depending on whether or not there is a brake actuation command. That is, Embodiment 7 of the present invention is an example in which Embodiment 2 of the present invention is combined with Embodiment 6 of the present invention.

Owing to the above-mentioned configuration as well, the brake device can adjust the magnitude of part of a total braking force generated at the time of emergency braking of the car 1, so it is possible to start the operation of emergency braking more reliably and swiftly while suppressing a deceleration at the time of emergency braking. It is therefore possible to prevent a deterioration in riding comfort resulting from an excessively high deceleration or an extension of braking distance resulting from an excessively low deceleration.

Embodiment 8

Figure 8:
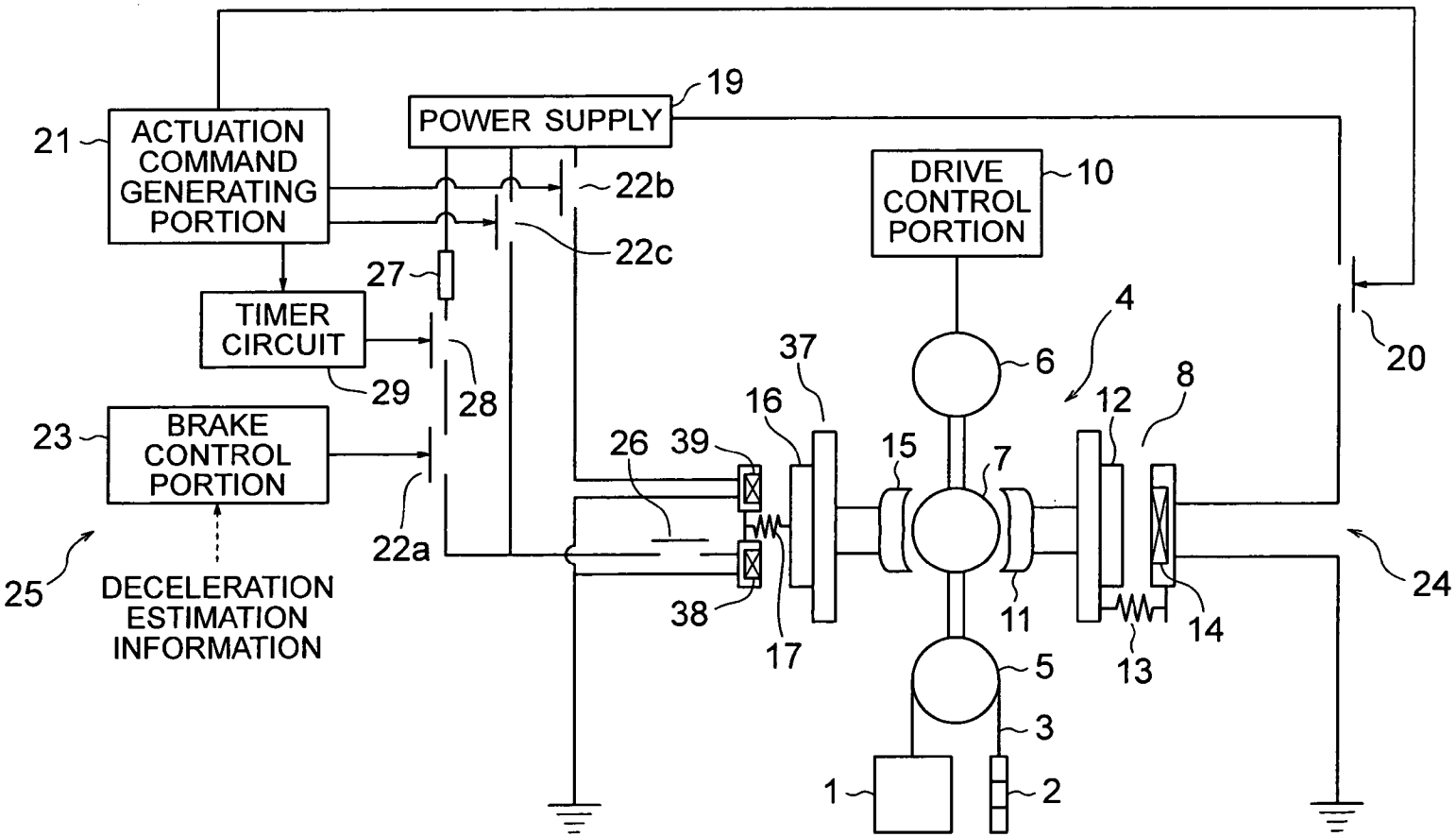
FIG. 8 is a schematic diagram showing an elevator apparatus according to Embodiment 8 of the present invention.

Next, FIG. 8 is a schematic diagram showing an elevator apparatus according to Embodiment 8 of the present invention. Referring to FIG. 8, a third brake switch 22*c* is connected between the second brake coil 38 and the power supply 19. A normal open/close switch is employed as the third brake switch 22*c*. The third brake switch 22*c* is directly opened/closed depending on whether or not there is a brake actuation command, without the intermediation of the brake control portion 23.

The adjustment switch 22*a*, the timer switch 28, and the current limiter 27 are connected in parallel with the third brake switch 22*c* between the second brake coil 38 and the power supply 19. The adjustment switch 22*a*, the timer switch 28, and the current limiter 27 are connected in series to one another. That is, Embodiment 8 of the present invention is an example in which Embodiment 4 of the present invention is combined with Embodiment 6 of the present invention.

Owing to the above-mentioned configuration as well, the brake device can adjust the magnitude of part of a total braking force generated at the time of emergency braking of the car 1, so it is possible to start the operation of emergency braking more reliably and swiftly while suppressing a deceleration at the time of emergency braking. It is therefore possible to prevent a deterioration in riding comfort resulting from an excessively high deceleration or an extension of braking distance resulting from an excessively low deceleration.

It is also appropriate to input a brake actuation command from the actuation command generating portion 21 to the brake control portion 23, and allow the brake control portion 23 to control the deceleration of the car 1 only when the brake actuation command is generated.

Embodiment 9

Figure 9:
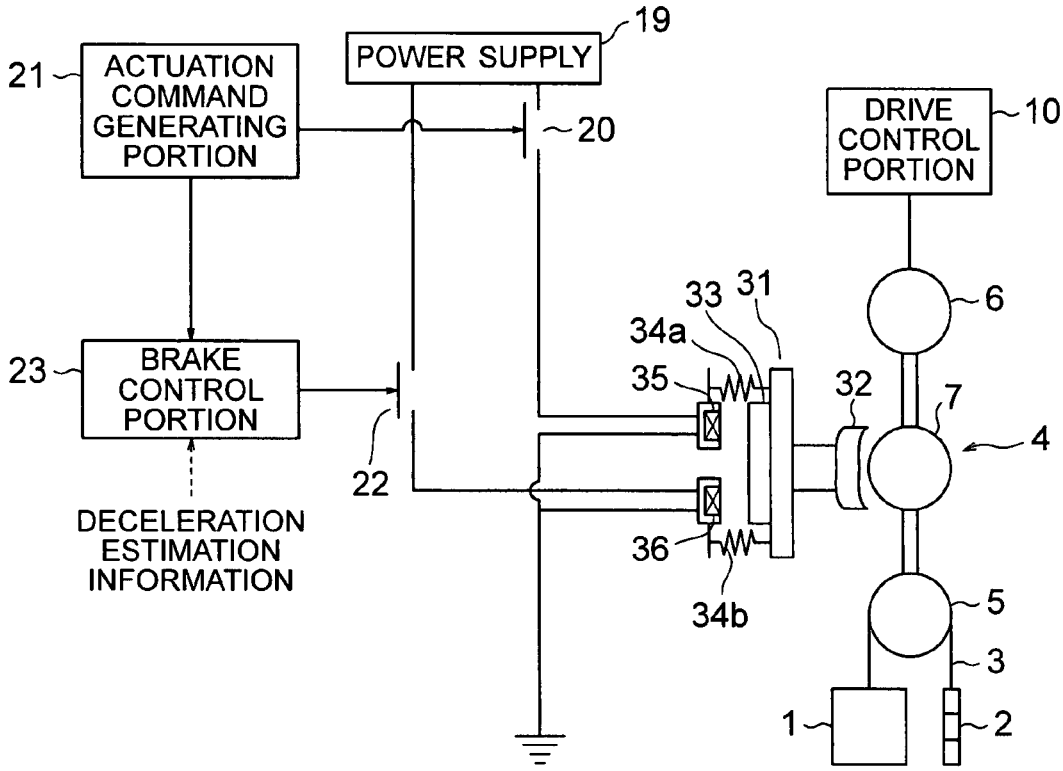
FIG. 9 is a schematic diagram showing an elevator apparatus according to Embodiment 9 of the present invention.

Next, FIG. 9 is a schematic diagram showing an elevator apparatus according to Embodiment 9 of the present invention. Referring to FIG. 9, the brake portion body 31 has the brake shoe 32, the armature 33, a first braking spring 34*a* for pressing the brake shoe 32 against the brake drum 7, a second braking spring 34*b* for pressing the brake shoe 32 against the brake drum 7, the first brake coil 35, and the second brake coil 36. Each of the first brake coil 35 and the second brake coil 36 is disposed facing the armature 33 to generate an electromagnetic force for opening the brake shoe 32 away from the brake drum 7 against a corresponding one of the braking springs 34*a* and 34*b*.

The first braking spring 34*a* is disposed at a position corresponding to the first brake coil 35. The second braking spring 34*b* is disposed at a position corresponding to the second brake coil 36. That is, the braking springs 34*a* and 34*b* are so disposed as to correspond to positions of the brake coils 35 and 36, respectively. Embodiment 9 of the present invention is identical to Embodiment 6 of the present invention in other configurational details.

In the elevator apparatus structured as described above, the braking forces of the nonadjustable brake portion and the adjustable brake portion can be adjusted by changing the capacities of the first brake coil 35 and the second brake coil 36 or the spring moduli of the first braking spring 34*a* and the second braking spring 34*b*, respectively.

Embodiment 10

Figure 10:
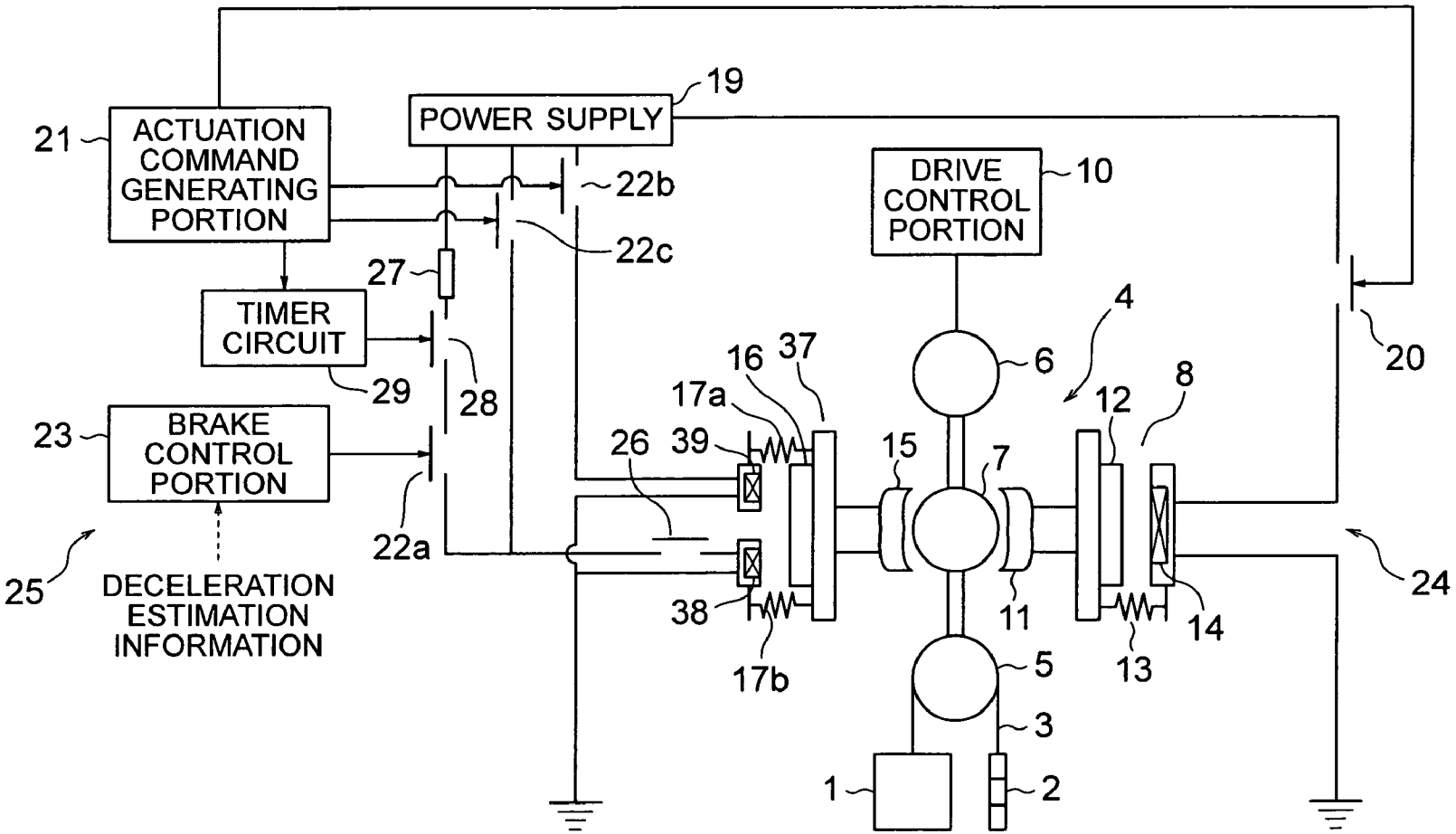
FIG. 10 is a schematic diagram showing an elevator apparatus according to Embodiment 10 of the present invention.

Next, FIG. 10 is a schematic diagram showing an elevator apparatus according to Embodiment 10 of the present invention. Referring to FIG. 10, the second brake portion body 37 has the second brake shoe 15, the second armature 16, a second braking spring 17*a*, a third braking spring 17*b*, the second brake coil 38, and the third brake coil 39. The second braking spring 17*a* is disposed at a position corresponding to the second brake coil 38. The third braking spring 17*b* is disposed at a position corresponding to the third brake coil 39. That is, the braking springs 17*a* and 17*b* are disposed so as to correspond to positions of the brake coils 38 and 39, respectively. Embodiment 10 of the present invention is identical to Embodiment 8 of the present invention in other configurational details.

Owing to the above-mentioned configuration as well, the brake device can adjust the magnitude of part of a total braking force generated at the time of emergency braking of the car 1, so it is possible to start the operation of emergency braking more reliably and swiftly while suppressing a deceleration at the time of emergency braking. It is therefore possible to prevent a deterioration in riding comfort resulting from an excessively high deceleration or an extension of braking distance resulting from an excessively low deceleration.

In Embodiment 10 of the present invention, it is also appropriate to input a brake actuation command from the actuation command generating portion 21 to the brake control portion 23, and allow the brake control portion 23 to control the deceleration of the car 1 only when the brake actuation command is generated.

The second braking spring 17 of Embodiment 7 of the present invention may be separately disposed, namely, as the second braking spring 17*a* and the third braking spring 17*b* as in the case of Embodiment 10 of the present invention.

Further, although the brake control portion 23 is constituted by the computer in the foregoing examples, an electric circuit for processing analog signals may be employed to constitute the brake control portion 23.

Still further, although the brake device is provided on the hoisting machine 4 in the foregoing examples, it is also appropriate to provide the brake device at another position. That is, the brake device may be a car brake mounted on the car 1, a rope brake for gripping the main rope 3 to brake the car 1, or the like.

The brake rotational body is not limited to the brake drum 7. For example, the brake rotational body may be a brake disc.

Further, three or more brake coils and three or more braking springs may be provided, respectively.

Still further, three or more brake portion bodies may be provided for a single brake rotational body.

The brake device is disposed outside the brake rotational body in the foregoing examples. However, the brake device may be disposed inside the brake rotational body.

Further, the brake rotational body may be integrated with the drive sheave 5.

The invention claimed is:

1. An elevator apparatus, comprising:

a car; and a brake device configured to stop the car, and to adjust a magnitude of part of a total braking force generated at a time of braking of the car, the brake device including a first brake portion configured to generate a braking force immediately without making an adjustment of the braking force, and a second brake portion configured to generate a braking force while making an adjustment to the braking force, the second brake portion including a second brake shoe that is brought into contact with and away from a brake rotational body, a second braking spring for pressing the second brake shoe against the brake rotational body, a second brake coil for generating an electromagnetic force for opening the second brake shoe away from the brake rotational body against the second braking spring, a brake control portion for controlling the electromagnetic force generated by the second brake coil, a brake control switch provided between the second brake coil and a power supply, and a forcible braking switch configured to invalidate any adjustment of the braking force to forcibly generate the total braking force of the second brake portion, the forcible braking switch provided between the second brake coil and the power supply and connected in series to the brake control switch.

2. The elevator apparatus according to claim 1, wherein the first brake portion has a braking force that can stop the car even when the braking force of the second brake portion remains canceled.

3. The elevator apparatus according to claim 1, wherein the first brake portion includes a first brake shoe that is brought into contact with and away from the brake rotational body that is rotated as the car runs, a first braking spring for pressing the first brake shoe against the brake rotational body, and a first brake coil for generating an electromagnetic force for opening the first brake shoe away from the brake rotational body against the first braking spring.

4. The elevator apparatus according to claim 1, wherein the forcible braking switch is opened and closed in response to an external signal.

5. The elevator apparatus according to claim 1, further comprising:

an actuation command generating portion configured to generate a brake actuation command; and a timer circuit configured to output a command to a timer switch after a lapse of a predetermined time from a time when the brake actuation command is received, the timer switch is connected in series to the brake control switch and is opened in response to the command from the timer circuit.

6. The elevator apparatus according to claim 5, wherein the second brake portion further includes a current limiter for limiting a current flowing through the second brake coil, the current limiter is connected between the timer switch and the power supply.

7. The elevator apparatus according to claim 5, wherein the brake control switch is responsive to the brake actuation command without the use of the brake control portion.

8. The elevator apparatus according to claim 5, further comprising:

an adjustment switch configured to control the current supplied to the second brake coil, the brake actuation command from the actuation command generating portion is input to the brake control portion, such that the brake control portion monitors a deceleration of the car, and controls an open/close state of the adjustment switch for controlling the deceleration of the car.

9. An elevator apparatus, comprising:

a car; and a brake device configured to stop the car, and to adjust a magnitude of part of a total braking force generated at a time of braking of the car, the brake device including a first brake portion configured to generate a braking force immediately without making an adjustment of the braking force, and a second brake portion configured to generate a braking force while making an adjustment to the braking force, the second brake portion including a second brake shoe that is brought into contact with and away from a brake rotational body, a second braking spring for pressing the second brake shoe against the brake rotational body, a second brake coil for generating an electromagnetic force for opening the second brake shoe away from the brake rotational body against the second braking spring, and a brake control portion for controlling the electromagnetic force generated by the second brake coil, and a third brake coil for generating an electromagnetic force for opening the second brake shoe away from the brake rotational body against the second braking spring, and the third brake coil is immediately stopped from being supplied with a current.

10. The elevator apparatus according to claim 9, wherein the second brake portion further comprises:

a brake control switch provided between the second brake coil and a power supply, and a forcible braking switch configured to invalidate any adjustment of the braking force to forcibly generate the total braking force of the second brake portion, the forcible braking switch provided between the second brake coil and the power supply and connected in series to the brake control switch.

11. The elevator apparatus according to claim 9, wherein the first brake portion has a braking force that can stop the car even when the braking force of the second brake portion remains canceled.

12. The elevator apparatus according to claim 9, wherein the first brake portion includes a first brake shoe that is brought into contact with and away from the brake rotational body that is rotated as the car runs, a first braking spring for pressing the first brake shoe against the brake rotational body, and a first brake coil for generating an electromagnetic force for opening the first brake shoe away from the brake rotational body against the first braking spring.

13. The elevator apparatus according to claim 12, wherein the first and second braking springs are disposed so that the first and second braking springs correspond to positions of the first and second brake coils, respectively.

14. The elevator apparatus according to claim 9, wherein the second brake portion further comprises:

a forcible braking switch for invalidating the adjustment of the braking force at the time of braking to forcibly generate a total braking force of the second brake portion.

15. The elevator apparatus according to claim 14, wherein the forcible braking switch is provided between the second brake coil and a power supply and connected in series to the second brake switch, and is opened in response to an external signal.

16. The elevator apparatus according to claim 9, wherein the second brake portion further comprises:

a current limiter for limiting a current flowing through the second brake coil, the current limiter is connected between the second break coil and the power supply.

17. The elevator apparatus according to claim 9, wherein the second brake portion further comprises:

a third braking spring for pressing the second brake shoe against the brake rotational body, the third braking spring corresponding to the third brake coil.

* * * * *